United States Patent [19]

Sander et al.

[11] Patent Number: 4,921,552

[45] Date of Patent: May 1, 1990

[54] COMPOSITION AND METHOD FOR NON-CHROMATE COATING OF ALUMINUM

[75] Inventors: Lothar S. Sander, Princeton, N.J.; Edward M. Musingo, Roslyn; William J. Neill, Wyndmoor, both of Pa.

[73] Assignee: Betz Laboratories, Inc., Trevose, Pa.

[21] Appl. No.: 189,567

[22] Filed: May 3, 1988

[51] Int. Cl.[5] ..... C23C 22/34

[52] U.S. Cl. ..... 14.8/247; 148/251

[58] Field of Search ..... 148/247, 251

[56] References Cited

U.S. PATENT DOCUMENTS

| | | | |
|---|---|---|---|
| 3,912,548 | 10/1975 | Faigen | 148/6.15 R |
| 4,191,596 | 3/1980 | Dollman et al. | 148/6.27 |
| 4,313,769 | 2/1982 | Frelin et al. | 148/6.27 |
| 4,370,173 | 1/1983 | Dollman | 134/3 |
| 4,370,177 | 1/1983 | Frelin et al. | 148/6.27 |
| 4,422,886 | 12/1983 | Das et al. | 148/31.5 |
| 4,545,842 | 10/1985 | Parsons | 156/310 |

*Primary Examiner*—Sam Silverberg

*Attorney, Agent, or Firm*—Alexander D. Ricci; Steven D. Boyd

[57] ABSTRACT

A chromate and phosphate free composition and method for forming a dried in place conversion coating for aluminum and aluminum alloys. The method entails the application of the composition to aluminum or aluminum alloys and allowing the composition to dry in place. The composition is an acidic aqueous solution preferably containing more than 8 grams per liter dihydro-hexafluozirconaic acid, more than 10 grams per liter polyacrylic acid and more than 0.17 grams per liter hydrofluoric acid in a ratio of 1:0.84:0.014. The solution forms a dried in place conversion coating having a weight of from 6 to 25 milligrams per square foot in treatment (contact and drying) times as short as 2 seconds.

9 Claims, No Drawings

COMPOSITION AND METHOD FOR NON-CHROMATE COATING OF ALUMINUM

FIELD OF THE INVENTION

The present invention relates generally to non-chromate coating for aluminum. More particularly, the present invention relates to an improved siccative, non-chromate coating for aluminum which is sufficiently concentrated so as to form a dried in place conversion coating on an aluminum surface of sufficient weight so as to meet or exceed the specifications for a typical chromium based treatment. In addition, the improved non-chromate coating of the present invention provides for conversion of the surface of the material being treated in a minimum amount of time, yet the satisfactorily treated surface may be efficiently dried.

BACKGROUND OF THE INVENTION

The purposes of the formation of a chromate conversation coating on the surface of aluminum are to provide corrosion resistance, improve adhesion of coatings and for aestnetic reasons. A conversation coating improves the adhesion of coating layers such as paints, inks, lacquers and plastic coatings. A chromate conversion coating is typically provided by contacting aluminum with an aqueous composition containing hexavalent or trivalent chromium ions, phosphate ions and fluoride ions. Growing concerns have arisen regarding the pollution effects of the chromate and phosphate discharged into rivers and waterways by such processes. Because of high solubility and the strongly oxidizing character of hexavalent chromium ions, conventional chromate conversion processes require extensive waste treatment procedures to control their discharge.

In addition to concerns with respect to waste products, when typical prior art chromium based treated materials are stored subsequent to treatment, prior to painting, it is well known that in some cases there is a deterioration in adhesion performance.

Attempts have been made to produce an acceptable chromate free-conversion coating for aluminum. For example, U.S. Pat. No. 4,313,769, which issued to Frelin et al., discloses an acidic aqueous coating solution containing relatively low concentrations of zirconium, hafnium, or titanium and fluoride which includes a surfactant to improve resistance of the treated aluminum to hot water discoloration. Similarly, U.S. Pat. No. 4,370,177, which issued to Frelin et al., discloses an aqueous coating solution containing relatively low concentration of zirconium, hafnium or titanium and a fluoride which includes at least two surfactants.

U.S. Pat. No. 3,912,548, which issued to Faigen, discloses a composition which produces a corrosion resistant siccative finish bonding surface which comprises interalia a polyacrylic acid and a soluble zirconium compound such as alkaline metal, ammonium fluozirconate or ammonium zirconium carbonate applied at a pH of from 6 to 8. U.S. Pat. No. 4,191,596, which issued to Dollman et al., discloses a composition for coating aluminum which comprises a polyacrylic acid and $H_2ZrF_6$, $H_2TiF_6$ or $H_2SiF_6$. The claims of the '596 patent are directed to a mixture of from about 0.5 to about 10 grams per liter of the polyacrylic acid and from about 0.2 to about 8 grams per liter of the metal acid applied at a pH of less than about 3.5. Examples of the '596 patent are limited to the use of from 2.05 to 4.11 grams per liter of the polyacrylic acid, and from 0.85 to 1.942 grams per liter of the metallic acids. Thus the ratios of polyacrylic acid:metal acid disclosed by Dollman range of from 2.1:1 to 4.8:1. No details with respect to the treatment time or coating weight are given for examples 1–3, while examples 5–7 were treated for 30 seconds. The '596 patent also discloses the use of HF in combination with polyacrylic acid and $H_2TiF_6$ in a concentrated replenishing solution.

SUMMARY OF THE INVENTION

The present invention provides a composition for coating the surface of aluminum and alloys thereof in which aluminum is the primary component. The composition of the present invention provides for the formation of a dried in place coating having a coating weight of from about 6 to about 25 milligrams per square foot in a treatment (application and dry off) time as short as about 2 seconds. The aqueous composition of the present invention consists essentially of (a) more than about 8 grams per liter of dihydro-hexafluozirconic acid, i.e., fluozirconic acid; (b) more than about 10 grams per liter of a water soluble polymer selected from acrylic acid and homopolymers thereof; and (c) more than about 0.17 grams per liter hydrofluoric acid. The composition of the present invention is applied in a ratio of a:b:c of 1:0.83–0.88:0.013–0.014.

The invention also provides a method of forming a dried in place conversion coating on an aluminum or aluminum alloy surface with an aqueous solution, which is effective in as little as 2 seconds, yet which is free of undesirable chromates and phosphates. The coating of the present invention is effective in the production of aluminum materials including coil stock such as siding and the like. In addition, the coating of the present invention exhibits no loss in adhesion performance even when stored for more than 3 months before painting.

DETAILED DESCRIPTION OF THE PREFERRED EMBODIMENTS

The present inventors have discovered that relatively concentrated solutions of polyacrylic acid, a dihydrohexafluo zirconic acid, and hydrofluoric acid are effective at forming a dried in place, non-chromate conversation coating on aluminum and alloys thereof. The relatively concentrated solution of the present invention forms an effective siccative coating having a weight in the desired range in as little as 2 seconds of contact time.

Heretofore, relatively low concentrations of a mixture of fluozirconic acid and a polyacrylic acid, with an excess of polyacrylic acid, have been employed to form conversion coatings on aluminum. Such prior art conversion coating compositions employed relatively low concentration due to the belief that at higher concentrations precipitation of zirconium would adversely affect the coating that formed. In addition to the possible precipitation of zirconium, the possibility of aluminum ion build up due to recycling of the solution was of concern. Such relatively low concentrations result in relatively low coating weights and required extended treatment times not conducive to use in high speed processing equipment.

The present inventors discovered that, contrary to conventional beliefs, a concentrated solution consisting of from about 10 to about 16 grams per liter of a water soluble polymer, from about 8 to about 19 grams per liter dihydro-hexafluozirconic acid, and from about 0.24 to about 0.36 grams per liter hydrofluoric acid is effective at forming a dried in place conversion coating weighing from about 6 to about 25 milligrams per square foot, in as little as 2 seconds of contact time. The coating shows no loss in adhesion performance even when stored for more than 3 months prior to painting, see example 5 below.

Useful polymers within the scope of the present invention include water soluble as well as water dispersable polymers. Preferrably the polymer is a homopolymer of acrylic acid and it is believed that water soluble co-polymers of acrylic acid will also be effective. In the preferred embodiment, the polymer is polyacrylic acid having a molecular weight of about 50,000.

The aqueous acidic composition of the present invention preferably contains more than about 8 grams per liter of fluozirconic acid such as dihydro-hexafluozirconic acid. More preferably the composition of the present invention contains from about 8 to about 19 grams per liter of dihydro-hexafluozirconic acid. It is believed that fluotitanic and fluosilicic acids would be similarly effective.

The composition of the present invention provides an effective dried in place conversion coating solution. The composition comprises a slight excess of fluozirconic acid and a relatively low concentration of hydrofluoric acid in a solution much more concentrated that heretofore employed. The relatively highly concentrated solution provides for the formation of a conversion coating in from about 20 seconds. In addition to the reduced process time, the compositions' ability to dry in place obviates prior art problems with regeneration of recycled solution and build up of aluminum ions in the solution. Thus, the present composition is particularly adapted to modern high speed processing equipment.

The upper limits of the concentration of the components of the present composition are practical limits determined by the dried in place nature of the composition. In addition to pH, temperature, and the alloy, the shape of the article being treated may effect the upper limits of the concentrations.

The pH of the present solution is preferably from about 1.7 to 2.7 and more preferably from about 2.0 to about 2.5. The present solution is preferably applied at a temperature of from ambient, about 60° F., up to about 100° F. In order to facilitate drying of the coating, higher application temperatures may be employed. Typically, application temperatures will not exceed about 150° F.

The conversion coating solution of the present invention provides a coating having a weight of from about 6 to about 25 milligrams per square foot in contact times as short as about 2 seconds. The weight of the conversion coating may be determined by stripping the coating from the treated metal in a 35% nitric acid solution and weighing in the manner well known in the art. The short contact times necessary to provide a coating weight within this desirable range as provided by the composition of the present invention, makes the present invention particularly useful in high speed coil line or similar processes.

The effectiveness of the composition and the method of the present invention is demonstrated by the following examples. In these examples, the effectiveness was evaluated with a variety of paint adhesion tests familiar to those skilled in the art. These tests include: "T-bend": the tendency for paint to disadhere from a 180° bend in the metal (O T=perfect); "Wedge bend": the amount of paint (in millimeters) lost from the surface above the minimum radius of curvature of a bend in the metal. The bend is formed by first turning the painted metal through a radius of about 0.5 cm and then flattening one end of the bend to a near zero radius; "Reverse impact": tendency of paint to disadhere from deformed metal caused by an impact of known momentum on the reverse side of the test surface. This test may be done on dry test panels or panels subjected to boiling water prior to impact (10=a perfect rating, noted in inch-lb impact); "Cross hatch/reverse impact": the tendency of paint to disadhere from areas between closely spaced lines through the paint scribed prior to reverse impact, this test may be done dry or following boiling water treatment (10=perfect rating); "Neutral salt spray": per ASTM-B-117 (10=perfect rating); "Acetic acid salt spray": per ASTM-b-287 (10=perfect rating).

EXAMPLE 1

Aluminum metal from an aluminum siding manufacturer was treated as follows: (1) cleaned with a commercial alkaline cleaner; (2) rinsed; and (3) treated with an aqueous solution of 12.2 grams per liter fluozirconic acid, 0.17 grams per liter hydrofluoric acid and 10.2 grams per liter polyacrylic acid (molecular weight approximately 50,000). The solution was applied in a laboratory spin coater; and (4) dried with a hot air stream. The coated aluminum was compared with a commercial chromium based treatment "AL-NR-3A (as described in U.S. Pat. No. 4,475,957 incorporated herein by reference)". The following is a summary of the performance data.

| Treatment | Avg. of T-Bends | Reverse Impact Avg. Rating at 40 in/lb | Avg. Boiling Water Cross Cross Hatch + Reverse Impact at 40 in/lb | 1000 HR NSS ASTM B-117 |
|---|---|---|---|---|
| Present Invention 15% AL-NR-3A | 0 T<br>0.6 T | 10<br>10 | 10<br>9.9 | 10<br>10 |

EXAMPLE 2

Aluminum on a coil line was treated as follows: 30 ft cleaning stage (residence time: 15.6 seconds); 15 ft hot water rinse (residence time 7.8 seconds); treatment with composition of the present invention in a chem-coater (drying time about 6 seconds); 400° F. oven dry and roll coat painting. The following are performance averages for two aluminum materials and two different paints.

| Avg. T-Bend | Reverse Impact Rating at 32 in-lbs | Avg. Boiling Water Cross Hatch + Reverse Impact at 32 in-lbs | 1000 HR NSS AASS ASTM B-117 | 240 HR AASS ASTM B-287 |
|---|---|---|---|---|
| 0 T | 10 | 10 | 10 | 9.8 |

EXAMPLE 3

A laboratory spin coater was employed to produce test panels as in Example 1 above. The weights, in grams per liter, of the fluozirconic acid, hydrofluoric acid, and polyacrylic acid were varied as shown. The treated panels were found to have coating weights directly proportional to the concentration of the treatment composition, and exhibited adhesion data as shown.

| Paint | $H_2ZrF_6$ | HF | Poly-acrylic acid | Coating Weight (mg/ft$^2$) | T-Bend | Wedge Bend (mm) |
|---|---|---|---|---|---|---|
| Polyester | 0 | | 0 | 0 | 3 T | 23 |
| Polyester | 3.2 | .044 | 2.7 | 2.5 | 2 T | 5 |
| Polyester | 6.1 | .84 | 5.4 | 7.0 | 1 T | 2 |
| Polyester | 12.2 | .17 | 10.2 | 19.9 | 1 T | 0 |
| Polyester | 18.3 | .26 | 15.3 | 25.3 | 2 T | 0 |
| Polyester | 15% v/v AL NR-3A | | | 8.6 | 2 T | 9 |
| Acrylic | 0 | 0 | 0 | 0 | 3 T | 22 |
| Acrylic | 3.2 | .044 | 2.7 | 2.5 | 2 T | 11 |
| Acrylic | 6.1 | .84 | 5.4 | 7.0 | 2 T | 15 |
| Acrylic | 12.2 | .17 | 10.2 | 19.9 | 2 T | 17 |
| Acrylic | 18.3 | .26 | 15.3 | 25.3 | 3 T | 20 |
| Acrylic | 15% v/v AL NR-3A | | | 8.6 | 3 T | 24 |

EXAMPLE 4

An aqueous solution of 12.2 grams per liter fluozirconic acid, 10.2 grams per liter polyacrylic acid and 0.17 grams per liter of hydrofluoric acid was applied to 3105-H-16 aluminum alloy on a coil treatment line similar to that described above. Coating weights of from about 6 to about 11 milligrams per square foot were achieved. Eight different paints were applied and cured immediately downstream of the treatment drying stage. The paint adherence was compared to the specification for a typical prior art chromium based treatment, AL-NR-3A. The results are summarized in the following table.

| Paint Type | T-Bend Present Invention | Specification for AL-NR-3A |
|---|---|---|
| 2 coat polyester | 2 T | 2 T |
| 2 coat primed polyester | 1 T | 1 T |
| 2 coat primed acrylic | 2 T | 2 T |
| 2 coat primed vinyl | 0 T | 1 T |
| 2 coat primed plastisol | 0 T | 0 T |
| 1 coat polyester(A) | 1 T | 1 T |
| 1 coat polyester(B) | 2 T | 2 T |
| 1 coat acrylic | 3 T | 3 T |

EXAMPLE 5

When the non-chromate dried in place coated metal of the present invention is stored, or aged, subsequent to treatment, prior to painting there is a complete lack ofo deterioration in adhesion performance. As shown by the following data, the present invention shows no deterioration in adhesion performance even when aged for more than 3 months between treatment and painting. Panels were cleaned and pretreated as follows: 1. Cleaned, 2. Rinsed, 3. Squeegie, 4. Dried, 5. Treated with solution as described in Example 1, 6. Dried, and 7. Painted. The results are summarized in the following table.

| | Metal Alloy | Paint System | Ageing (days) | Coating Weight mg/ft$^2$ | T-Bend |
|---|---|---|---|---|---|
| 1. | 3105K | Acrylic | 107 | 12.8 | 2 T |
| 2. | 3105K | Acrylic | 0 | 20.2 | 2 T |
| 3. | 3003Q | Acrylic | 0 | 17.5 | 2 T |
| 4. | 3003Q | Acrylic | — | Untreated | 3 T |
| 5. | 3105K | Polyester | 107 | 12.8 | 2 T |
| 6. | 3105K | Polyester | 0 | 20.2 | 2 T |
| 7. | 3003Q | Polyester | 0 | 17.5 | 2 T |

-continued

| | Metal Alloy | Paint System | Ageing (days) | Coating Weight mg/ft$^2$ | T-Bend |
|---|---|---|---|---|---|
| 8. | 3003Q | Polyester | — | Untreated | 5 T+ |

| | Paint System | Ageing (days) | Cross Hatch Reverse Impact 40 in/lbs | Boiling Water Cross Hatch Reverse Impact 40 in/lbs |
|---|---|---|---|---|
| 1. | Acrylic | 107 | 10 | 10 |
| 2. | Acrylic | 0 | 10 | 10 |
| 3. | Acrylic | 0 | 10 | 10 |
| 4. | Acrylic | — | 10 | 2 |
| 5. | Polyester | 107 | 10 | 0 |
| 6. | Polyester | 0 | 10 | 0 |
| 7. | Polyester | 0 | 10 | 0 |
| 8. | Polyester | — | 4 | 0 |

K - customer coil stock
Q - Q-Panel stock (Q-Panel Company)

As can be seen from Examples 1 through 5, the composition of the present invention provides a dried in place conversion coating which meets or exceeds the specifications for the commercially accepted AL-NR-3A chromium based conversion coating and which shows no loss of adhesion performance during storage prior to painting. As shown in Example 3, the conversion coating of the present invention preferably weighs from about 6 to about 25 mg per sq. ft. A dried in place conversion coating having this weight is provided by the composition of the present invention in contact times as low as 2 seconds without the use of noxious chromates or phosphates.

It should be understood that the foregoing description of the invention is not intended to be limiting, but is only exemplary of the inventive features which are defined in the claims.

What is claimed is:

1. An aqueous acidic solution which is effective in forming a dried in place non-chromate conversion coating on the surface of aluminum or alloys thereof, consisting essentially of:

(a) from greater than 10 to about 16 grams per liter of a polymer selected from the group consisting of polyacrylic acid and homopolymers thereof;

(b) from greater than 12 to about 19 grams per liter dihydro-hexafluozirconic acid; and (c) from about 0.17 to about 0.3 grams per liter hydrofluoric acid wherein the ratio of a:b:c is in the range of about 0.84 to about 0.89:1: up to about 0.02.

2. The solution of claim 1, wherein the ratio of a:b:c is about 0.84:1:0.014.

3. The solution of claim 1, having a pH of from about 1.7 to about 2.7.

4. The solution of claim 1, having a pH of from about 2.0 to about 2.5.

5. A method of forming a conversion coating on the surface of aluminum or alloys thereof, comprising: applying to said surface an aqueous acidic solution consisting essentially of:

(a) from greater than 10 to about 16 grams per liter of a polymer selected from the group consisting of polyacrylic acid and homopolymers thereof;

(b) from greater than 12 to about 19 grams per liter dihydro-hexafluozirconic acid; and (c) from about 0.17 to about 0.26 grams per liter hydrofluoric acid; and allowing said solution to dry on said surface in a length of time sufficient to form a conversion coating weighing from about 6 to about 25 milligrams per square foot wherein the ratio of a:b:c of said solution is in the range of about 0.84 to about 0.89:1: about 0.013 to about 0.014.

6. The method of claim 5, wherein the ratio of a:b:c of said solution is about 0.84:1:0.014.

7. The method of claim 5, wherein the pH of said solution is from about 1.7 to about 2.7.

8. The method of claim 5, wherein the pH of said solution is from about 2.0 to about 2.5.

9. The method of claim 5, wherein said solution comprises essentially about 10.2 grams per liter said polyacrylic acid, about 12.2 grams per liter said fluozirconic acid and 0.17 grams per liter said hydrofluoric acid.

* * * * *